US012103061B2

(12) United States Patent
Bergmann et al.

(10) Patent No.: US 12,103,061 B2
(45) Date of Patent: Oct. 1, 2024

(54) COLD ROLLING ROLLED STOCK IN A MILL TRAIN WITH MULTIPLE ROLL STANDS

(71) Applicant: Primetals Technologies Austria GmbH, Linz (AT)

(72) Inventors: Martin Bergmann, Linz (AT); Konrad Krimpelstaetter, Gallneukirchen (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 268 days.

(21) Appl. No.: 17/641,477

(22) PCT Filed: Sep. 7, 2020

(86) PCT No.: PCT/EP2020/074901
§ 371 (c)(1),
(2) Date: Mar. 9, 2022

(87) PCT Pub. No.: WO2021/048038
PCT Pub. Date: Mar. 18, 2021

(65) Prior Publication Data

US 2022/0355356 A1 Nov. 10, 2022

(30) Foreign Application Priority Data

Sep. 10, 2019 (EP) ..... 19196307

(51) Int. Cl.
*B21B 37/74* (2006.01)
*B21B 1/28* (2006.01)
(Continued)

(52) U.S. Cl.
CPC ..... *B21B 37/74* (2013.01); *B21B 1/28* (2013.01); *B21B 3/00* (2013.01); *B21B 37/46* (2013.01);
(Continued)

(58) Field of Classification Search
CPC ..... B21B 37/46; B21B 37/74; B21B 38/006; B21B 45/004; B21B 45/0218; B21B 45/0251
See application file for complete search history.

(56) References Cited

U.S. PATENT DOCUMENTS 5,425,820 A 6/1995 Yashiki et al. ..... 148/307
9,056,343 B2 6/2015 Su et al.
(Continued)

FOREIGN PATENT DOCUMENTS

CN 101522326 A 9/2009
CN 102834191 A 12/2012
(Continued)

OTHER PUBLICATIONS

Chinese Office Action dated Apr. 13, 2023, issued in corresponding Chinese Patent Application No. 202080063610.X with English translation of CN Search Report.
(Continued)

*Primary Examiner* — Teresa M Ekiert
(74) *Attorney, Agent, or Firm* — OSTROLENK FABER LLP

(57) ABSTRACT

A method for cold rolling rolled stock (2) in a mill train (1) with multiple roll stands (3 to 7). An upper limit temperature and/or a lower limit temperature is provided for a rolled stock temperature of the rolled stock (2) for at least one rolling pass, and the rolled stock temperature is controlled and/or regulated by at least one control or regulating measure such that during the at least one rolling pass, the rolled stock temperature does not exceed the upper limit temperature specified for the rolling pass and/or the rolled stock temperature does not fall below the lower limit temperature specified for the rolling pass.

13 Claims, 2 Drawing Sheets

(51) Int. Cl.

| | |
|---|---|
| ***B21B 3/00*** | (2006.01) |
| ***B21B 27/10*** | (2006.01) |
| ***B21B 37/46*** | (2006.01) |
| ***B21B 38/00*** | (2006.01) |
| ***B21B 45/00*** | (2006.01) |
| ***B21B 45/02*** | (2006.01) |

(52) U.S. Cl.

CPC ..... *B21B 38/006* (2013.01); *B21B 45/004* (2013.01); *B21B 45/0218* (2013.01); *B21B 45/0251* (2013.01); *B21B 2027/103* (2013.01); *B21B 2261/20* (2013.01); *B21B 2275/06* (2013.01)

(56) References Cited

U.S. PATENT DOCUMENTS

| | | | | |
|---|---|---|---|---|
| 9,314,827 | B2 | 4/2016 | Atalla et al. | |
| 9,358,594 | B2 | 6/2016 | Nikkuni et al. | |
| 10,632,377 | B2 | 4/2020 | Fujinaga et al. | |
| 2010/0050727 | A1 | 3/2010 | Botta | 72/205 |
| 2012/0067095 | A1* | 3/2012 | Hohenbichler | B21B 37/74 72/11.3 |
| 2016/0059283 | A1 | 3/2016 | Breuer et al. | |
| 2020/0269296 | A1* | 8/2020 | Bergmann | B21B 45/0218 |

FOREIGN PATENT DOCUMENTS

| | | | |
|---|---|---|---|
| CN | 103249504 | A | 8/2013 |
| CN | 105142810 | A | 12/2015 |
| CN | 108284130 | A | 7/2018 |
| CN | 109622619 | A | 4/2019 |
| DE | 69310218 | T2 | 10/1997 |
| DE | 10 2009 056 264 | A1 | 6/2011 |
| EP | 2532450 | A1 | 12/2012 |
| EP | 2 651 577 | B1 | 1/2015 |
| EP | 3 461 566 | A1 | 4/2019 |
| JP | S61-132205 | A | 6/1986 |
| JP | H01-218710 | A | 8/1989 |
| JP | H03-61325 | A | 3/1991 |
| JP | H08-085825 | A | 4/1996 |
| JP | H11-267717 | A | 10/1999 |
| JP | H11-297460 | A | 10/1999 |
| JP | 2000-167614 | A | 6/2000 |
| JP | 2000-202509 | A | 7/2000 |
| JP | 2005-205432 | A | 8/2005 |
| JP | 2005-211963 | A | 8/2005 |
| JP | 2008-105099 | A | 5/2008 |
| JP | 2009-106975 | A | 5/2009 |
| JP | 2013-220471 | A | 10/2013 |
| JP | 107433284 | A | 12/2017 |
| JP | 6272412 | B1 | 1/2018 |
| JP | 7032006 | B2 | 3/2022 |
| SU | 1678480 | A2 | 9/1991 |
| WO | WO 2011/067123 | A1 | 6/2011 |
| WO | WO 2019/145079 | A1 | 8/2019 |

OTHER PUBLICATIONS

International Search Report mailed Nov. 16, 2020 in corresponding PCT International Application No. PCT/EP2020/074901.

Written Opinion mailed Nov. 16, 2020 in corresponding PCT International Application No. PCT/EP2020/074901.

Search Report mailed Feb. 21, 2020 in corresponding European Patent Application No. 19196307.3.

F. Hell, "Grundlagen der Wärmeübertragung" [Principles of Heat Transfer], VDI-Verlag 1982, ISBN No. 3-18-400529-1, pp. 77-85 (see specification at p. 5 for relevance).

H. Hoffmann, "Handbuch Umformen" [Forming handbook], 2012, ISBN 978-3-446-42778-5, pp. 112-113 (see specification at p. 6 for relevance).

J.B.A.F. Smeulders, Lubrication in the Cold Rolling Process Described by a 3D Stribeck Curve, AISTech 2013 Proceedings, pp. 1681-1689.

Office Action dated Nov. 7, 2023, issued in corresponding Chinese Patent Application No. 202080063610.X with English translation of CN Search Report.

Writing team of Wire Parameters of Changqing Iron and Steel Design Institute, Metallurgical Industry press; Wire rod rolling shop process design reference material, 1st edition; Metallurgical Industry Press, Mar. 31, 1979; pp. 182-183.

Zheng Shuqin et al., "Principles of Mechanics", 1st Edition, National Defense Industry Press, Jul. 31, 2016, pp. 181-183.

Office Action dated Apr. 4, 2024, issued in corresponding Chinese Patent Application No. 202080063610.X with English translation of CN Search Report.

Fang Shixing et al., "A High speed wire rod mill equipment technology", 1st Edition, Jan. 31, 1997, pp. 24-28, ISBN: 7-5024-1998-5; 1997 with English Translation.

EPO Communication of a Notice of Opposition dated May 17, 2024 issued in corresponding European Patent Application No. 20768550.4.

Autorenkollektiv der Technischen Hochschule otto von Guericke Magdeburg, "Walzwerke, Maschinen und Anlagen" Leipzig: VFB Deutscher Verla für Grundstoffindustrie, 1980, Ed. Auflage ISBN: 5415154 and its English translation attached.

Kopp, Reiner et al.: "Einführung in die Umformtechnik"; Achen: Verlag Main; 1999; ISBN: 3-86073-821-6; 1999 and its English translation attached.

Pawelski, Hartmut: "Reduction of energy consumption in cold rolling", Rolling & surface treatment, Session 2; presentation on the METEC InSteelCon 2011 from the 27.06 bis Jan. 7, 2011; Jun. 27, 2011, and its English translation attached.

Pawelski, Hartmut et al.: "Technische Pastomechanik"; Düsseldorf: Verlag Stahleisen GmbH, 200; ISBN: 3-514-00695-8, and its English translation attached.

* cited by examiner

COLD ROLLING ROLLED STOCK IN A MILL TRAIN WITH MULTIPLE ROLL STANDS

CROSS-REFERENCE TO RELATED APPLICATIONS

The present application is a 35 U.S.C. §§ 371 national phase conversion of PCT/EP2020/074901, filed Sep. 7, 2020, the contents of which are incorporated herein by reference, which claims priority of European Patent Application No. 19196307.3 filed Sep. 10, 2019, the contents of which are incorporated by reference herein. The PCT International Application was published in the German language.

The invention relates to the cold rolling of rolled stock in a rolling train having multiple rolling stands.

In a rolling stand, a rolled stock, which is generally a metallic rolled strip, is rolled in a rolling gap between two working rollers of the rolling stand in order to reduce the thickness of the rolled stock. Often multiple rolling stands, through which the rolled stock passes in succession in order to successively reduce the thickness of the rolled stock, are arranged in a rolling train. Rolling of the rolled stock in one of the rolling stands is referred to as a rolling pass. In a rolling train with multiple rolling stands, multiple rolling passes are therefore performed in succession. The reduction in the thickness of the rolled stock in a rolling pass is referred to as pass reduction of the rolling pass. In cold rolling, the rolled stock is rolled at a rolled-stock temperature below the recrystallization temperature.

For applications in the technical field of electromobility among other things, magnetic steel sheets with high silicon contents are becoming increasingly important. The high brittleness of these magnetic steel sheets can lead to numerous difficulties.

Specifically in the case of cold forming, for example frequent strip cracks and therefore unstable production conditions for the cold rolling. By increasing the temperature of the rolled stock, its brittleness can be reduced.

On the other hand, on the basis of its principle, in the case of cold rolling, the rolled-stock temperature must not exceed the recrystallization temperature of the rolled stock. Moreover, the rolled-stock temperature in the case of cold rolling should generally also be limited for other reasons. For example, in the case of cold rolling, a lubricant is usually applied to the working rollers of the rolling stands and/or to the rolled stock in order to reduce friction between the rolled stock and the working rollers. The lubricant itself is or contains a rolling oil that can crack at high temperatures, for example above 200° C.

Furthermore, the cold rolling can have downstream processing steps for processing the cold-rolled stock, for example coating the rolled stock, for which an excessively high rolled-stock temperature is disadvantageous. In the case of coating the rolled stock, for example, the result is reduced adhesion of the coating. Furthermore, a high rolled-stock temperature can result in increased wear of mill equipment, for example plastics-coated deflection rollers for the rolled stock or storage saddles for the rolled stock, or in thermal deformation of the working-roller contour in the axial direction, which adversely affects the flatness of the rolled stock.

JP H01 218710 A proposes heating a rolled strip entering a cold-rolling stand to a temperature of between 100° C.-500° C., and applying lubricant on the run-in side and water as coolant on the run-out side to the working rollers of the rolling stand. On the one hand, the heating is intended to reduce the forming resistance of the rolled strip, and on the other hand, the application of cooling water is intended to prevent destruction of the lubricating film on the working rollers due to overheating and excessive thermal deformation of the working rollers.

The invention is based on the object of specifying a method and a rolling train for the cold rolling of rolled stock having multiple rolling stands which are improved in terms of controlling the temperature of the rolled stock during the rolling and/or after the rolling.

The object is achieved according to the invention.

In the method according to the invention for the cold rolling of rolled stock in a rolling train having multiple rolling stands through which the rolled stock passes in succession, an upper limit temperature and/or a lower limit temperature for a temperature of the rolled stock is predetermined for at least one selected rolling pass, in particular for each rolling pass. The rolled-stock temperature is open-loop and/or closed-loop and is controlled by at least one of the following open-loop or closed-loop control measures in such a way that the rolled-stock temperature in each selected rolling pass does not exceed the upper limit temperature predetermined for the rolling pass and/or does not fall below the lower limit temperature predetermined for the rolling pass:

- heating the rolled stock to a run-in temperature before the first rolling pass,
- cooling the working rollers of at least one rolling stand by applying a roller coolant to the working rollers, wherein a flow of the roller coolant and/or a pressure of the roller coolant is open-loop or closed-loop controlled,
- cooling the rolled stock between at least two rolling passes which follow one another by applying a rolled-stock coolant to the rolled stock, wherein a flow of the rolled-stock coolant and/or a pressure of the rolled-stock coolant is open-loop or closed-loop controlled,
- applying a lubricant to the working rollers or/and to the rolled stock in at least one rolling pass, wherein a flow of the lubricant and/or a pressure of the lubricant is open-loop or closed-loop controlled,
- compiling and implementing a pass sequence distribution for the pass reductions of the individual rolling passes,
- open-loop or closed-loop controlling a rolling speed at which the rolled stock passes through the rolling train.

The invention therefore provides for the rolled-stock temperature to be controlled in at least one rolling pass such that it does not exceed an upper limit temperature specific to the rolling pass and/or does not fall below a lower limit temperature specific to the rolling pass. This makes it possible in general to reduce malfunctions such as strip cracks and consequently to increase the throughput of a rolling train. In particular, the production conditions for the cold rolling of critical rolled stock, such as magnetic steel sheets having a high silicon content, are improved or even provided in the first place. By appropriately predetermining the limit temperatures, the final temperature of the rolled stock at the run-out of the rolling train can also be selectively influenced, which means that flexible further processability of the cold-rolled stock can be achieved. Furthermore, by appropriately predetermining the limit temperatures, it is possible to minimize a run-in temperature of the rolled stock that is required at the run-in of the rolling train, and thereby save on energy for heating the rolled stock before the first rolling pass. Furthermore, by appropriately predetermining the limit temperatures, the mill equipment can be protected in order to reduce wear.

The open-loop or closed-loop control measures mentioned are particularly appropriate for influencing the rolled-stock temperature during the cold rolling. Thus, heating the rolled stock before the first rolling pass reduces the brittleness of the rolled stock and thus the risk of strip cracks in the rolled stock.

The cooling of working rollers and/or of the rolled stock between rolling passes counteracts heating of the working rollers and of the rolled stock when the rolled stock is being cold formed. In the case of roller cooling by means of roller coolant dispensed onto the working rollers, the amount of heat discharged from the working rollers can be determined from the modeling of the heat transfer (determination of the heat transfer coefficient between a roller surface and the roller coolant) and is known, for example, from F. Hell: "Grundlagen der Wärmeübertragung" [Principles of heat transfer], VDI-Verlag 1982, ISBN number 978-3-18-400529-0, pages 77-85. As an alternative, the heat transfer coefficient can also be determined empirically as a function of the flow of the roller coolant and the pressure of the roller coolant (what is referred to as table model). From this, it is possible to determine the temperature of the working rollers, from which in turn the heat flow between the rolled stock and the working rollers , i.e. the amount of heat discharged from the rolled stock to the working rollers, in the rolling gap can be determined and regulated by corresponding open-loop or closed-loop control of the flow of the roller coolant and/or the pressure of the roller coolant, such that the rolled-stock temperature in the rolling gap can be selectively set. In the same way, when the rolled stock is cooled by means of rolled-stock coolant applied to the rolled stock, the amount of heat discharged from the rolled stock to the rolled-stock coolant can be determined by modeling the heat transfer, if the flow of the rolled-stock coolant and the pressure of the rolled-stock coolant are known, either by an exemplary model-based determination mentioned above by way of example or by an empirical determination of the heat transfer coefficient between the rolled-stock coolant and the surface of the rolled stock on which it is discharged as a function of the flow of the rolled-stock coolant and the pressure of the rolled-stock coolant. From this in turn, by corresponding open-loop or closed-loop control of the flow of the rolled-stock coolant and/or the pressure of the rolled-stock coolant, the heat flow from the rolled stock and consequently the temperature of the rolled stock can be selectively set in those regions of the rolling mill in which the rolled stock has rolled-stock coolant directly applied to it.

Applying a lubricant to the working rollers or/and to the rolled stock in at least one rolling pass reduces the friction between the rolled stock and the working rollers and thus counteracts heating of the rolled stock and/or of the working rollers. The more lubricant that is applied, the lower is the resulting frictional power loss during the rolling. The latter is calculated in principle from an applied rolling force, a coefficient of friction and a differential speed between the rolled strip and the working rollers in the rolling gap of the respective rolling stand. The rolling force is generally predetermined by a mill automation of the rolling train in order to achieve the desired pass reduction at the relevant stand and is therefore known. As an alternative, the current rolling force, for example in the event of a thickness adjustment, can also be measured online continuously using devices that generate the rolling force at the relevant rolling stand (for example hydraulic cylinders). For determining the differential speed in the rolling gap, formula (3.13), for example, in H. Hoffmann: "Handbuch Umformen" [Forming handbook], 2012, ISBN 978-3-446-42778-5, is known, in which the run-in and run-out speed of the rolled stock at the rolling stand and the rolling-gap geometry, which depends on the diameters of the working rollers and the pass reduction at the corresponding stand, are included. For example, empirical values can be used to determine the coefficient of friction in the rolling gap. For example, the parameters that are known for a specific rolling operation—surface quality, material properties and application of lubricant—thus determine the coefficient of friction. As an alternative, modeling of the friction coefficient is also known from J. B. A. F. Smeulders: Lubrication in the Cold Rolling Process Described by a 3D Stribeck Curve, AISTech 2013 Proceedings.

The reduction in thickness of the rolled stock to be achieved in the rolling train is divided between the individual rolling stands by a pass sequence distribution for the pass reductions of the individual rolling passes. In principle, the rolled stock is heated in each rolling stand by the plastic deformation of the rolled stock. The deformation heat generated in the rolled stock during this process can be easily determined by a person skilled in the art from the pass reduction at the respective rolling stand and from material properties of the rolled stock. An appropriate selection of pass reductions, which takes into account all of the stands of the rolling train, can have the effect, for example, that a predetermined temperature range for the rolled-stock temperature is maintained over the entire rolling train.

The rolling speed is understood to mean a speed at which the rolled stock passes through the rolling stands of the rolling train. The rolling speed can directly influence the above-mentioned frictional power losses at the individual rolling stands, since the differential speeds in the individual rolling stands are also directly affected by the rolling speed. The rolling speed therefore also influences the rolled-stock temperature in the individual rolling passes.

In order to influence the rolled-stock temperature during cold rolling in a rolling train having multiple rolling stands through which the rolled stock passes in succession, according to the invention, multiple open-loop or closed-loop control measures are thus available which respectively influence the rolling process via a corresponding manipulated variable and which make it possible to keep the rolled-stock temperature within a certain temperature range, which is predetermined by a lower and an upper limit temperature, throughout the passage of the rolled stock through the rolling train. These manipulated variables include the heat output of a heating device for setting a run-in temperature of the rolled strip before the first rolling pass, the cooling parameters for setting the amount of heat that is discharged from the rolled stock as a result of the contact of the rolled stock with the working rollers and as a result of the rolled-stock coolant applied to the rolled stock, the lubrication parameters for setting the frictional power loss in the rolling gap of the respective rolling stands, the pass sequence distribution for setting the deformation heat of forming generated during the pass reduction in the respective rolling stands, and the rolling speed, which likewise influences the frictional power loss during the pass reduction in the individual rolling stands.

The above-mentioned open-loop or closed-loop control measures can be performed independently of one another. In this case, for example on the basis of a simulation by a computing unit, it is possible to determine the resulting rolled-stock temperatures in advance, i.e. before the rolling operation itself is actually carried out. This computing unit may be identical to the controller that carries out the open-loop or closed-loop control measures on the rolling train during the actual rolling operation.

Specifically, this means that, for example proceeding from preset values for the individual manipulated variables, firstly the temperature profile of the rolled stock is determined, over a certain rolling pass or over the entire rolling train, for example

- the amount of heat discharged from the rolled stock to the working rollers and to the rolled-stock coolant on account of the cooling parameters that were preset at the first rolling stand is determined,
- further, the frictional power loss in the rolling gap of the first rolling stand on account of the lubrication parameters that were preset at the first rolling stand and the rolling speed that was preset at the first rolling stand is furthermore determined, and
- the deformation heat generated on account of the preset pass sequence distribution at the first rolling stand is determined from the pass reduction at the first rolling stand and from the material properties of the rolled stock.

On the basis of these determined heat flows, and proceeding from a run-in temperature of the rolled stock preset by means of a heating device or determined otherwise, it is possible to determine the resulting rolled-stock temperature downstream of the first rolling stand after applying the rolled-stock coolant. The rolled-stock temperature determined in this way, downstream of the first rolling stand, can be used as a starting point to determine in the same way the rolled-stock temperature downstream of the second rolling stand on the basis of the rolling speed, pass reduction and cooling and lubrication parameters that were preset at the second roll stand. This successive determination of the rolled-stock temperature can be continued until the rolled stock emerges from the last rolling stand of the rolling train.

If a violation of the upper and/or lower temperature limit has been determined, one of the above-mentioned open-loop or closed-loop control measures can then be applied with values for the respective manipulated variable that deviate from the preset values, and the rolled-stock temperature can be computationally redetermined in order to check whether the predetermined limit temperatures are maintained when parameters for the open-loop or closed-loop control measures are changed. The check can be carried out again after each change in the applied manipulated variables.

For example, if it is determined that the rolled-stock temperature is exceeded at a certain rolling stand, the lubrication applied and/or the cooling at this stand can be increased in order to reduce the frictional power loss and/or increase the amount of heat removed from the rolled stock.

In the case of what is referred to as a 'global optimization problem', a solution is sought in which multiple criteria are to be taken into account at the same time with predetermination of a target function. The target function weighs the individual criteria individually, and it is possible for these criteria to include e.g. a desired temperature control over the entire rolling train, an optimized pass sequence in terms of desired material properties, a highest possible throughput rate through the rolling train, adhering to a certain rolling-force distribution or the lowest possible use of coolant and lubricant. The computational effort for finding a solution to a global optimization problem increases disproportionately with the number of variable parameters.

Although the independent execution of one or more of the above-mentioned open-loop or closed-loop control measures does not necessarily provide the optimum solution in relation to a global optimization problem of this type, an independent implementation of the execution of one or more of the above-mentioned open-loop or closed-loop control measures is appropriate for this, for example as a retrofitting solution for existing controllers of rolling trains. This is because the checking whether an applied open-loop or closed-loop control measure ensures that the limit temperatures are adhered to is in any case only proportional to the rolling stands of the rolling train, but it does not depend on the number of variable parameters themselves. The computational power required in such a case may therefore also be provided by a controller of the rolling train itself. For example, when changing the cooling parameters at a certain rolling stand, only the rolled-stock temperatures in the region of the rolling stand downstream of the relevant rolling stand need to be redetermined. However, even in the case of an additional applied change in the pass sequence or the rolling speed, each of which has an effect on all of the rolling stands of the rolling train, the number of amounts of heat amounts that need to be redetermined in the manner described above is restricted by precisely this total number of rolling stands in order to check that the limit temperatures are adhered to.

In one embodiment of the invention, a model-based calculation of the run-in temperature of the rolled stock, the cooling and lubrication parameters, the pass sequence distribution and the rolling speed is performed as a solution to a global optimization problem, with predetermination of a target function. Under one global optimization problem, a multiplicity of solutions can arise, among which the most appropriate one is determined likewise on the basis of a model, for example first taking into account further criteria, for example by additionally maximizing the rolling speed or maintaining a certain rolling-force distribution on the rolling stands 3 to 7.

In one embodiment of the invention, an upper limit temperature in the range of between 140° C. and 250° C. and/or a lower limit temperature in the range of between 20° C. and 140° C. is predetermined for at least one rolling pass. Such an upper limit temperature makes it possible in particular to avoid the aforementioned cracking of rolling oil used as a lubricant or a constituent of a lubricant. The lower limit temperature depends on the material and is therefore adapted to the rolled stock.

In a further embodiment of the invention, a common upper limit temperature and/or a common lower limit temperature are predetermined for all of the rolling passes. This simplifies the method according to the invention in comparison with an embodiment with limit temperatures that depend on the rolling pass.

In a further embodiment of the invention, the rolled stock is heated to a run-in temperature by means of a heating device, in particular an induction heater, before the first rolling pass. In the case of inductive heating of the rolled stock, the heating of the rolled stock can be easily determined from a power of the induction heater, the efficiency and the exposure time, which results from the rolled-stock speed and the overall length of the heater, and of material properties of the rolled stock, in particular its specific heat capacity.

In a further embodiment of the invention, the working rollers of at least one rolling stand are cooled by applying a roller coolant to the working rollers only on the run-out side. The run-out side of a rolling stand is understood to be the side of the rolling stand on which the rolled stock leaves the rolling stand. Correspondingly, the run-in side of a rolling stand is understood to be the side of the rolling stand on which the rolled stock enters the rolling stand. Applying a roller coolant to the working rollers on the run-out side is more efficient than applying it on the run-in side, since due to the direction of rotation of the working rollers means that the heat generated by the rolling operation is discharged immediately, while in case of roller cooling on the run-in side, the relevant location of the working roller has to perform about half a revolution before.

In a further embodiment of the invention, a lubricant is applied to the working rollers or/and to the rolled stock in at least one rolling pass by creating a mixture of the lubricant and a carrier gas in an atomization device and spraying the mixture onto the working rollers and/or onto the rolled stock by means of lubricant nozzles. Such an application of lubricant is known, for example, from EP 2 651 577 B1 and has the advantage over the application of a lubricating emulsion, for example, that the lubricant can be applied very selectively and economically.

In a further embodiment of the invention, a lubricant is applied to the working rollers or/and to the rolled stock only on the run-in side during at least one rolling pass. This is advantageous in particular in the case of rolling passes in which coolant is applied only on the run-out side, because in that case no lubricant is washed off by the coolant and lubricant is thus saved.

In a further embodiment of the invention, a parameter value is determined offline for at least one parameter of an open-loop or closed-loop control measure on the basis of a calculation model of at least part of the rolling train, and the parameter is set to the parameter value during operation of the rolling train. The parameters that can be determined by a calculation model include a run-in temperature of the rolled stock, cooling parameters (e.g. flows of the roller coolant, pressures of the roller coolant, flows of the rolled-stock coolant and pressures of the rolled-stock coolant), lubrication parameters (e.g. flows of the lubricant and pressures of the lubricant), a pass sequence distribution (i.e. the pass reductions of the individual rolling passes), and a rolling speed.

In these configurations of the invention, at least a subset of the parameters for the open-loop or closed-loop control of the rolled-stock temperature is thus determined (in particular calculated) in advance.

In a further refinement of the invention, at least two parameter values determined offline are determined as a solution to a global optimization problem with predetermination of a target function. In addition to the maintenance of the upper and lower limit temperatures, this advantageously allows at least one further criterion to be taken into account during the rolling operation of the rolled stock.

In a further embodiment of the invention, at least one measured value of the rolled-stock temperature is recorded during operation of the rolling train, and at least one parameter of an open-loop or closed-loop control measure is set online as a function of at least one measured value. In this embodiment of the invention, at least a subset of the parameters for the open-loop or closed-loop control of the rolled-stock temperature is therefore set online as a function of a measured temperature of the rolled stock. This can in particular affect the cooling and lubrication of the working rollers and/or of the rolled stock.

A rolling train according to the invention comprises multiple rolling stands for the cold rolling of rolled stock and a controller which is configured to execute at least one of the open-loop or closed-loop control measures mentioned above. The rolling train may further comprise in particular:

- a heating device that can be open-loop or closed-loop controlled by the controller and is configured to heat the rolled stock before the first rolling pass, and/or
- a cooling system that can be open-loop or closed-loop controlled by the controller and is configured to dispense a roller coolant onto the working rollers of at least one rolling stand and/or a rolled-stock coolant onto the rolled stock between at least two rolling passes which follow one another, and/or
- a lubrication system that can be open-loop or closed-loop controlled by the controller and is configured to dispense a lubricant onto the working rollers and/or onto the rolled stock during at least one rolling pass, and/or
- at least one measuring unit that is configured to record a temperature of the rolled stock at any desired location in the rolling train.

The advantages of such a rolling train correspond to the above-mentioned advantages of the method according to the invention.

The above described properties, features and advantages of this invention and the manner in which they are achieved will become clearer and more clearly understandable in connection with the following description of exemplary embodiments, which are explained in more detail in conjunction with the drawings, in which:

DESCRIPTION OF EMBODIMENTS

Figure 1:
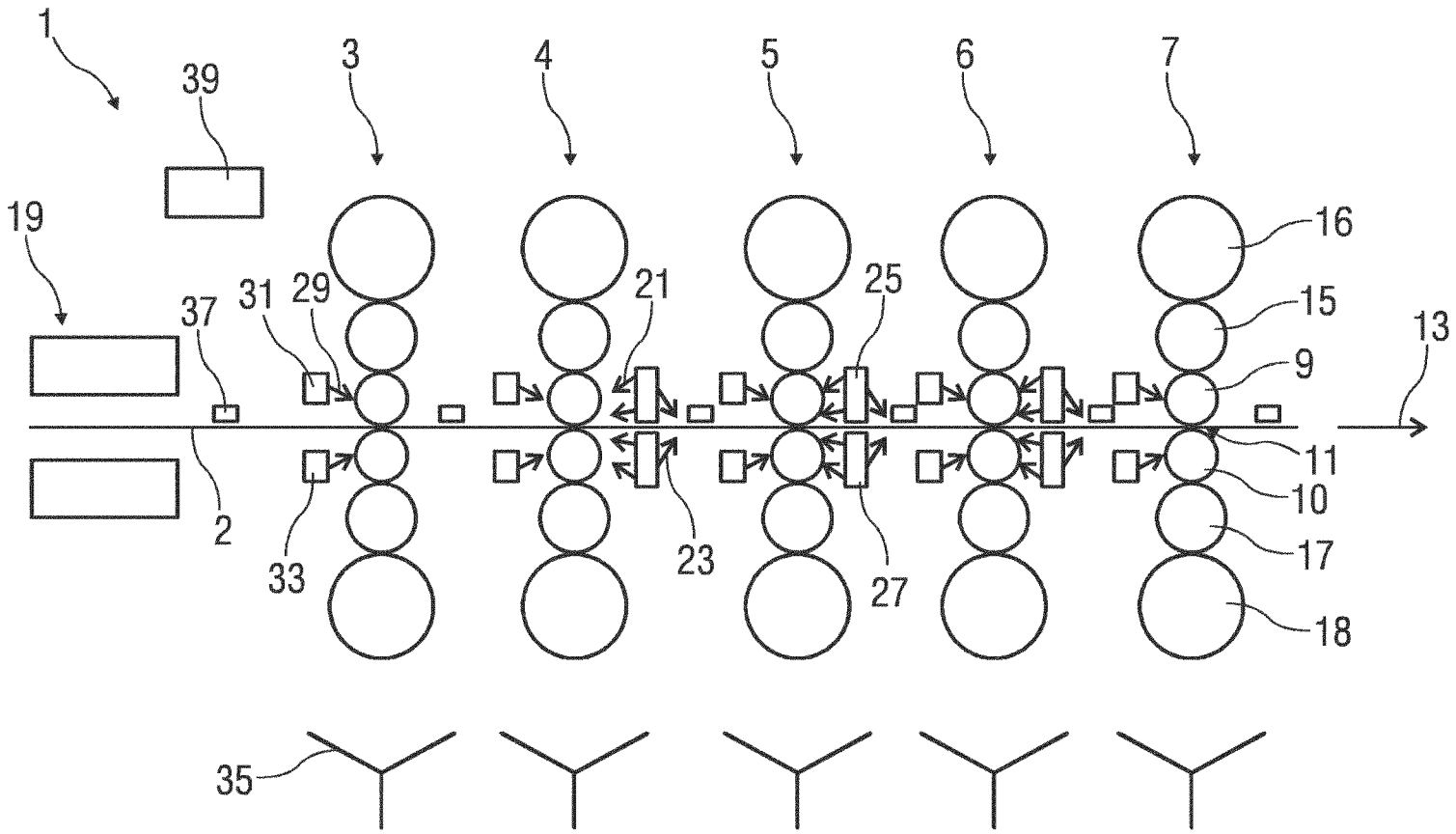
FIG. 1 schematically shows an exemplary embodiment of a rolling train according to the invention.

FIG. 1 (FIG. 1) schematically shows an exemplary embodiment of a rolling train 1 according to the invention having five rolling stands 3 to 7 for the cold rolling of rolled stock 2. Each rolling stand 3 to 7 has two working rollers 9, 10, which are arranged one above the other and are spaced apart from one another by a rolling gap 11. To roll the rolled stock 3, the working rollers 9, 10 are set in rotation by a motor and the rolled stock 3 is pulled by the rotating working rollers 9, 10 in a rolling direction 13 through the rolling gaps 11.

In the exemplary embodiment of a rolling train 1 shown in FIG. 1, each rolling stand 3 to 7 further has for each working roller 9, 10 two back-up rollers 15 to 18, which are arranged one on top of the other on a side of the respective working roller 9, 10 that faces away from the rolled stock 2, with a first back-up roller 15, 17 making contact with the second back-up roller 16, 18 and the working roller 9, 10.

Each rolling stand 3 to 7 carries out a rolling pass in which the thickness of the rolled stock 2 is reduced by what is referred to as the pass reduction of the rolling pass. A heating device 19 is arranged at the entrance of the rolling train 1 and is configured to heat the rolled stock 2 before the first rolling pass, which is carried out by a first rolling stand 3. The heating device 19 is for example embodied as an induction heater, by means of which the rolled stock 3 can be inductively heated.

The rolling train 1 also comprises a cooling system which is configured to dispense a roller coolant 21 onto the working rollers 9, 10 of the rolling stands 4 to 6, which carry out the second, the third and the fourth rolling pass, and to dispense a rolled-stock coolant 23 onto the rolled stock 2 between the second and the third rolling pass, the third and the fourth rolling pass, and the fourth and the fifth rolling pass. The cooling system comprises an upper cooling bar 25 and a lower cooling bar 27 for each of the rolling stands 4 to 6. By means of the upper cooling bar 25, roller coolant 21 can be dispensed on the run-out side onto the upper working roller 9 of the respective rolling stand 4 to 6 and rolled-stock coolant 23 can be dispensed onto an upper surface of the rolled stock 3. By means of the lower cooling bar 27, roller coolant 21 can be dispensed on the run-out side onto the lower working roller 10 of the respective rolling stand 4 to 6 and rolled-stock coolant 23 can be dispensed onto a lower surface of the rolled stock 3. Each cooling bar 25, 27 comprises, for example, multiple roller-coolant nozzles, by means of which the roller coolant 21 can be dispensed onto the respective working roller 9, 10, and/or multiple rolled-stock-coolant nozzles, by means of which the rolled-stock coolant 23 can be dispensed onto the rolled stock 2.

The roller coolant 21 is, for example, water or a cooling emulsion. The rolled-stock coolant 23 is likewise water or a cooling emulsion, for example, and can match the roller coolant 21. A cooling emulsion consists of a cooling liquid and a lubricant, for example water as the cooling liquid and oil as the lubricant, and possibly of emulsifiers. In this respect, the main component of the cooling emulsion is the cooling liquid, while the lubricant content of the cooling emulsion is only a few percent, for example two to three percent. For example, the amount of roller coolant 21 applied to the two working rollers 9, 10 of a rolling stand 4 to 6 (in total, i.e. to the two working rollers 9, 10 together) in liters per minute corresponds approximately to a motor power of the rolling stand 4 to 6 in kW, with the motor power being the power of a motor that drives the working rollers 9, 10 of the rolling stand 4 to 6.

The rolling train 1 moreover has a lubrication system which is configured to dispense a lubricant 29 on the run-in side onto the working rollers 9, 10 of all of the rolling stands 3 to 7. The lubrication system has an upper lubricating bar 31 and a lower lubricating bar 33 for each rolling stand 3 to 7. By means of the upper lubricating bar 31, lubricant 29 can be dispensed on the run-in side onto the upper working roller 9 of the respective rolling stand 3 to 7. By means of the lower lubricating bar 33, lubricant 29 can be dispensed on the run-in side onto the lower working roller 10 of the respective rolling stand 3 to 7. For example, each lubricating bar 31, 33 comprises an atomization device in which a mixture of the lubricant 29 and a carrier gas can be created, and multiple lubricant nozzles by means of which the mixture can be sprayed onto the respective working roller 9, 10. Here, the lubricant 29 is pure rolling oil, for example, and the carrier gas is air, for example. For example, a maximum of two liters of rolling oil per minute are dispensed onto each working roller 9, 10. As an alternative, the lubricant 29 is a lubricating emulsion consisting of a carrier liquid and rolling oil and possibly emulsifiers, and each lubricating bar 31, 33 has lubricant nozzles by means of which the lubricating emulsion can be dispensed onto the respective working roller 9, 10.

Arranged under the rolling stands 3 to 7 are collecting devices 35 which are configured to collect roller coolant 21, rolled-stock coolant 23 and lubricant 29 that flow off from the rolling stands 3 to 7. The mixture of roller coolant 21, rolled-stock coolant 23 and lubricant 29 that is collected by the collecting devices 35 is preferably broken down into its constituents, which are then reused.

The rolling train 1 furthermore has multiple measuring units 37 which are each configured to record a temperature of the rolled stock 2. A measuring unit 37 is arranged between the heating device 19 and the first rolling stand 3, further measuring units 37 are arranged respectively between two adjacent rolling stands 3 to 7, and a measuring unit 37 is arranged at the end of the rolling train 1 downstream of the rolling stand 7, which carries out the fifth rolling pass.

The rolling train 1 also has a controller 39 by means of which the heating device 19, the cooling system, i.e. the flows of the roller coolant, the pressures of the roller coolant, the flows of the rolled-stock coolant and the pressures of the rolled-stock coolant that are respectively dispensed by the cooling bars 25, 27, and the lubrication system, i.e. the flows of the lubricant and pressures of the lubricant that are respectively dispensed from the lubricating bars 31, 33, respectively can be open-loop or closed-loop controlled in order to open-loop or closed-loop control the temperature of the rolled stock 2 in each rolling pass. For this purpose, a temperature range for the rolled-stock temperature between an upper limit temperature and a lower limit temperature is predetermined for each rolling pass, and the rolled-stock temperature is open-loop and/or closed-loop controlled in such a way that the rolled-stock temperature in each rolling pass takes on a temperature value within the temperature range predetermined for the rolling pass. In addition to the open-loop or closed-loop control of the heating device 19, of the cooling system and of the lubrication system, a pass sequence distribution for the pass reductions of the individual rolling passes is compiled and implemented. The rolling stands 3 to 7, i.e. the gap heights of the rolling gaps 11 of the rolling stands 3 to 7, are set according to the pass sequence distribution. Furthermore, a rolling speed at which the rolled stock 2 passes through the rolling train 1 is open-loop or closed-loop controlled in order to influence the rolled-stock temperature in the rolling passes. The rolling speed is set by the rotational speeds of the working rollers 9, 10.

The parameters of the open-loop and/or closed-loop control of the temperature are a run-in temperature of the rolled stock 2 to be set by means of the heating device 19, the flows of the roller coolant, the pressures of the roller coolant, the flows of the rolled-stock coolant and the pressures of the rolled-stock coolant that are respectively dispensed by the cooling bars 25, 27 (cooling parameters), the flows of the lubricant and the pressures of the lubricant that are respectively dispensed by the lubricating bars 31, 33 (lubrication parameters), the pass sequence distribution and the rolling speed. These parameters are respectively determined, for example, offline on the basis of a calculation model of at least part of the rolling train 1. For example, a model-based calculation of the run-in temperature of the rolled stock 2, the cooling and lubrication parameters, the pass sequence distribution and the rolling speed is conducted as a solution to a global optimization problem, with predetermination of a target function. This result in a multiplicity of solutions, among which the most appropriate one is likewise determined on the basis of a model, for example by taking into account further criteria, for example by additionally maximizing the rolling speed or maintaining a certain rolling-force distribution on the rolling stands 3 to 7. The parameters (offline parameters) determined in this way are each set manually or by the controller 39. As an alternative, some or all of the parameters (online parameters) can be regulated online as a function of the measured values from the measuring units 37 in such a way that the rolled-stock temperature in each rolling pass takes on a temperature value within the temperature range predetermined for the rolling pass. For example, the pass sequence distribution, the run-in temperature of the rolled stock 2 and the rolling speed are determined offline, while the cooling and lubrication parameters are regulated online as a function of the measured values from the measuring units 37.

Figure 2:
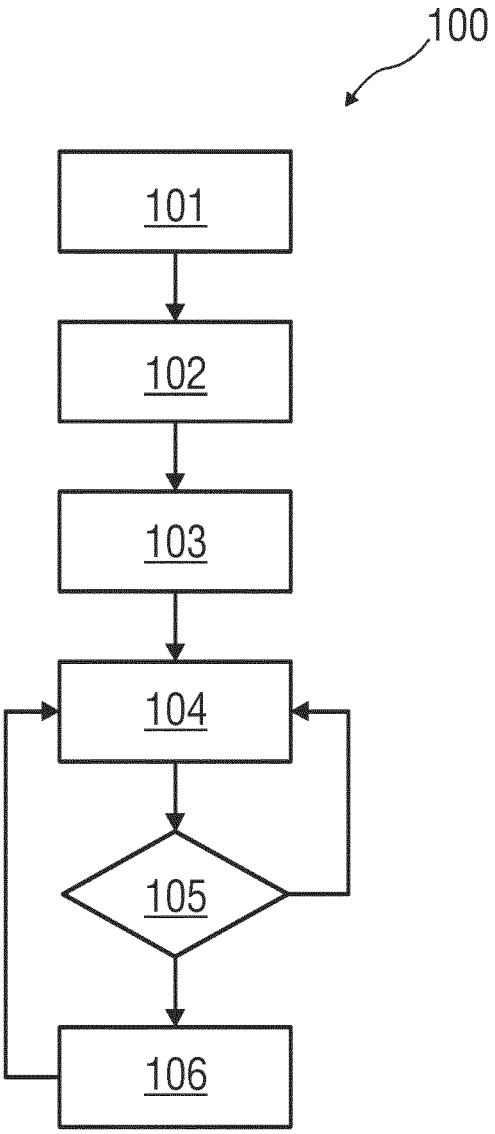
FIG. 2 shows a flow diagram of an exemplary embodiment of the method according to the invention.

FIG. 2 (FIG. 2) shows a flow diagram 100 of an exemplary embodiment of the method according to the invention for the cold rolling of rolled stock 2 in a rolling train 1, having method steps 101 to 106.

In a first method step 101, for each rolling pass a temperature range for the temperature of the rolled stock 2 in the rolling pass is predetermined.

In a second method step 102, as described above the offline parameters are determined on the basis of a calculation model of at least part of the rolling train 1, for example the pass sequence distribution, the run-in temperature of the rolled stock 2 and the rolling speed.

In a third method step 103, the cold rolling of the rolled stock 2 in the rolling train 1 is started using the offline parameters determined in the second method step 102 and predetermined initial values of the online parameters.

In a fourth method step 104, for each rolling pass a temperature of the rolled stock 2 is determined. For example, to this end the rolled-stock temperature is recorded for a rolling pass by means of at least one measuring unit 37, or the rolled-stock temperature in the rolling pass is calculated, for example as described above, by means of a calculation of the heat flow between the rolled stock and the working rollers in the rolling gap on the basis of a modeling of the heat transfer and/or by means of a calculation of the resulting deformation heat due to the plastic deformation of the rolled stock when the rolled stock is being rolled.

In a fifth method step 105, a check is made as to whether the rolled-stock temperature in each rolling pass takes on a temperature value within the temperature range predetermined for the rolling pass. If the check reveals that the rolled-stock temperature in each rolling pass takes on a temperature value within the temperature range predetermined for the rolling pass, the fourth method step 104 is carried out again. Otherwise, a sixth method step 106 is carried out.

In the sixth method step 106, the value of at least one online parameter is changed in order to bring the rolled-stock temperature into the predetermined temperature range in each rolling pass in which the rolled-stock temperature is outside the temperature range predetermined for the rolling pass. After the sixth method step 106, the fourth method step 104 is carried out again.

Although the invention has been illustrated and described in more detail by the preferred exemplary embodiment, the invention is not limited by the examples disclosed, and other variations can be derived therefrom by a person skilled in the art without departing from the scope of protection of the invention.

LIST OF REFERENCE SIGNS

1 Rolling train
2 Rolled stock
3 to 7 Rolling stand
9, 10 Working roller
11 Rolling gap
13 Rolling direction
15 to 18 Back-up roller
19 Heating device
21 Roller coolant
23 Rolled-stock coolant
25, 27 Cooling bars
29 Lubricant
31, 33 Lubricating bars
35 Collecting device
37 Measuring unit
39 Controller
100 Flow diagram
101 bis 106 Method step

The invention claimed is:

1. A method for the cold rolling of a rolled stock in a rolling train having multiple rolling stands through which the rolled stock passes in succession in multiple rolling passes, the method comprising:

setting heat output of a heating device, heating the rolled stock to a run-in temperature by the heating device before a first rolling pass from the multiple rolling passes, cooling working rollers of at least one rolling stand of the multiple rolling stands by open-loop or closed-loop controlling at least a flow of a roller coolant or at least a pressure of the roller coolant that is applied to the working rollers, determining the amount of heat discharged from the working rollers when the working rollers are being cooled by the roller coolant and the amount of heat discharged from the rolled stock to the working rollers, cooling the rolled stock between at least two consecutive rolling passes from the multiple rolling passes by open-loop or closed-loop controlling at least a flow of a rolled-stock coolant or at least a pressure of the rolled-stock coolant that is applied to the rolled stock, determining the amount of heat discharged from the rolled stock to the rolled-stock coolant when the rolled stock is being cooled by the rolled-stock coolant, applying a lubricant to at least the working rollers or to at least the rolled stock in at least one rolling pass from the multiple rolling passes by open-loop or closed-loop controlling at least a flow of the lubricant or at least a pressure of the lubricant, determining a frictional power loss in the rolling gap of the at least one rolling stand, compiling and implementing a pass sequence distribution for pass reductions of the multiple rolling passes, determining deformation heat resulting from plastic deformation during pass reduction of the rolled stock at each rolling stand of the rolling train from the pass reduction at each rolling stand of the rolling train and from the material properties of the rolled stock, open-loop or closed-loop controlling a rolling speed at which the rolled stock passes through the rolling train, and determining resulting frictional power loss in each rolling stand of the rolling train, wherein any one of the open-loop or closed loop controlling steps is carried out so that rolled-stock temperature in the at least one rolling pass does not exceed a predetermined upper temperature limit or does not fall below a predetermined lower temperature limit, or both.

2. The method as claimed in claim 1, wherein the temperature of the rolled stock is controlled so that the predetermined upper temperature limit is in the range of 140° C. and 250° C.

3. The method as claimed in claim 1, wherein the temperature of the rolled stock is controlled so that the predetermined lower temperature limit is in the range of 20° C. and 140° C. is predetermined for at least one rolling pass.

4. The method as claimed in claim 1, wherein the temperature of the rolled stock is controlled so that the rolled-stock temperature does not exceed the predetermined upper temperature limit for all of the multiple rolling passes.

5. The method as claimed in claim 1, wherein the temperature of the rolled stock is controlled so that the rolled-stock temperature does not fall below the predetermined lower temperature limit for all of the multiple rolling passes.

6. The method as claimed in claim 1, wherein the heating device is embodied as an induction heater.

7. The method as claimed in claim 1, further comprising mixing the lubricant with a carrier gas in an atomization device, wherein the applying a lubricant comprises spraying the mixture by means of lubricant nozzles.

8. The method as claimed in claim 1, further comprising determining offline a parameter value for at least one parameter of at least one of the open-loop or closed-loop controlling on the basis of a calculation model of at least part of the rolling train and setting the at least one parameter to the parameter value during operation of the rolling train.

9. The method as claimed in claim 8, wherein the parameter value is a run-in temperature of the rolled stock, a cooling parameter, a lubrication parameter, a pass sequence distribution, a rolling speed.

10. The method as claimed in claim 8, further comprising determining another parameter value offline, wherein the two parameter values are determined as a solution to a global optimization problem with predetermination of a target function.

11. The method as claimed in claim 1, further comprising recording at least one measured value of the rolled-stock temperature during operation of the rolling train, and setting online at least one parameter of at least one of the open-loop or closed-loop controlling as a function of the at least one measured value.

12. A rolling train having multiple rolling stands for the cold rolling of rolled stock, comprising:

a controller, a heating device that can be open-loop or closed-loop controlled by the controller and is configured to heat the rolled stock before the first rolling pass, a cooling system that can be open-loop or closed-loop controlled by the controller and is configured to dispense a roller coolant onto the working rollers of at least one rolling stand and/or a rolled-stock coolant onto the rolled stock between at least two rolling passes which follow one another, a lubrication system that can be open-loop or closed-loop controlled by the controller and is configured to dispense a lubricant onto the working rollers or/and onto the rolled stock in at least one rolling pass, wherein the controller is configured to execute at least one of the open-loop or closed- loop controlling steps of claim 1 to control the heating device, the cooling system, and the lubrication system so that the rolled-stock temperature in the at least one rolling pass does not exceed a predetermined upper temperature limit or does not fall below a predetermined lower temperature limit, or both.

13. The rolling train as claimed in claim 12, having at least one measuring unit that is configured to record a temperature of the rolled stock at any desired location in on the rolling train.

* * * * *